US012447384B2

(12) United States Patent
Thompson

(10) Patent No.: US 12,447,384 B2
(45) Date of Patent: Oct. 21, 2025

(54) LACROSSE STICK HEAD MOUNTING SYSTEM

(71) Applicant: Garth Thompson, Baltimore, MD (US)

(72) Inventor: Garth Thompson, Baltimore, MD (US)

( * ) Notice: Subject to any disclaimer, the term of this patent is extended or adjusted under 35 U.S.C. 154(b) by 9 days.

(21) Appl. No.: 15/223,354

(22) Filed: Jul. 29, 2016

(65) Prior Publication Data

US 2017/0036080 A1 Feb. 9, 2017

Related U.S. Application Data

(60) Provisional application No. 62/201,159, filed on Aug. 5, 2015.

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20; A63B 2102/14; A63B 60/46
USPC ..... 473/513; 403/376, 510–513
See application file for complete search history.

(56) References Cited

U.S. PATENT DOCUMENTS 6,485,381 B1 * 11/2002 Pai ..... A63B 49/035 473/521
7,393,294 B2 7/2008 Filice et al.
8,721,477 B2 5/2014 Chung
2004/0134304 A1 * 7/2004 Wu ..... B62K 21/26 74/551.8
2005/0282666 A1 * 12/2005 Morrow ..... A63B 60/08 473/513
2006/0019777 A1 * 1/2006 Rogers ..... A63B 59/20 473/513
2006/0040771 A1 * 2/2006 Filice ..... A63B 49/035 473/513
2008/0318714 A1 12/2008 Kotula et al.
2014/0144417 A1 5/2014 Evans
2014/0243120 A1 * 8/2014 Chauvin ..... A63B 60/06 473/513
2015/0104251 A1 * 4/2015 Sgroi, Jr. ..... F16B 7/105 403/376
2015/0297964 A1 * 10/2015 Evans ..... A63B 37/001 473/513

OTHER PUBLICATIONS

Form PCT/ISA/237; Written Opinion of the International Searching Authority; Form PCT/ISA/220 and Form PCT/ISA/210; International Search Report; mailed Oct. 24, 2016 in corresponding International Application No. PCT/US 16/44671 (13 pages).

* cited by examiner

*Primary Examiner* — Jeffrey S Vanderveen
(74) *Attorney, Agent, or Firm* — STAAS & HALSEY LLP

(57) ABSTRACT

A lacrosse stick head has a protrusion at a base of the lacrosse stick head, which internally mounts to the lacrosse stick handle or pole. The protrusion has an angled end, which makes contact with the angled end of the wedged end cap. The protrusion and the wedged end cap are drawn together via a screw through the centerline of the lacrosse stick head and mated to a threaded wedged end cap, creating a wedging force internal to the lacrosse stick handle or pole, and uniting of the lacrosse stick head to the lacrosse stick handle or pole.

13 Claims, 3 Drawing Sheets

LACROSSE STICK HEAD MOUNTING SYSTEM

CROSS-REFERENCE TO RELATED APPLICATIONS

This application is based upon and claims the benefit of priority of U.S. Provisional Application Ser. No. 62/201,159, filed Aug. 5, 2015, the entire contents of which are incorporated herein by reference.

BACKGROUND

1. Field

This invention relates to how a lacrosse stick head is mounted or affixed to a lacrosse stick handle or pole.

2. Description of the Related Art

Most lacrosse stick heads are mounted to the lacrosse stick handle or pole via a single screw which penetrates the lacrosse stick head and lacrosse stick handle or pole where the two pieces overlap.

Thus if the single screw becomes loosened due to vibration or torsion force, the lacrosse stick head will become loosened from the lacrosse stick handle or pole thereby causing the user to have less control over the combined lacrosse stick head and lacrosse stick handle or pole assembly.

SUMMARY

In one aspect, a lacrosse stick head is comprised of a protrusion at the base of the lacrosse stick head, which internally mounts to the lacrosse stick handle or pole, which said protrusion has an angled end, which makes contact with the angled end of the wedged end cap, which are drawn together via a screw through the centerline of the lacrosse stick head and mated to the threaded wedged end cap creating a wedging force internal to the lacrosse stick handle or pole creating the union of the lacrosse stick head to the lacrosse stick handle or pole.

In another aspect, a lacrosse stick head has a first wedge surface of a base and an oblique wedged end cap and a head longitudinal axis. The oblique wedged end cap is disposed proximate to the first wedge surface. The head longitudinal axis is substantially coaxial with a head base longitudinal axis.

In another aspect, a head assembly made up of the lacrosse stick head and the oblique wedged end cap is inserted into a handle. A fastener is passed through a throat of the lacrosse stick head and is substantially coaxial with the head longitudinal axis.

In another aspect, the handle may have a cross-section that is circular, square, triangular, oval, or a polygon.

In another aspect, an angle of the first wedge surface relative to the head longitudinal axis may be oblique, acute, nonzero, positive, 30°, and 45°.

In another aspect, contact between the first wedge surface and the oblique wedged end cap can be repositioned relative to each other to create an offset relative to an axial position of the first wedge surface and the oblique wedged end cap that resists rotation of the lacrosse stick head about the handle longitudinal axis.

In another aspect, contact between the first wedge surface and the oblique wedged end cap can be repositioned relative to each other to create an offset relative to an axial position of the first wedge surface and the oblique wedged end cap that resists longitudinal motion of the lacrosse stick head along the handle longitudinal axis.

In another aspect, the fastener may be a head screw, a bolt, a rivet, a spike, and an anchor.

In another aspect, a lacrosse stick head mounting system has a head having a throat and a basket. The head is fastened to a handle by a fastener. The throat has a planar throat surface at an oblique angle to an axis of rotation of the fastener through the throat. An oblique wedged end cap has a planar handle surface at the oblique angle to the axis of rotation. The planar handle surface contacts the planar throat surface to resist rotation of the head about the axis of rotation.

The above and other features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
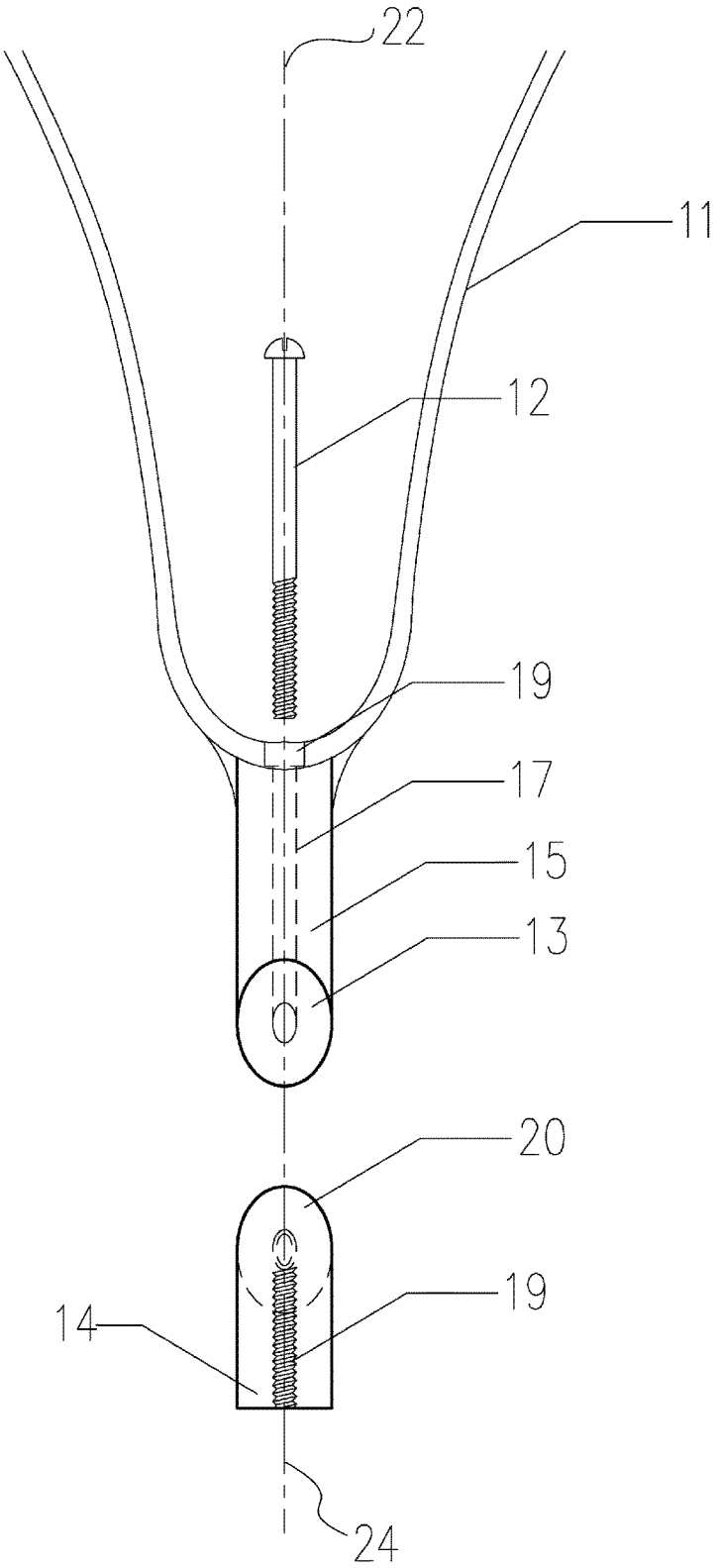
FIG. 1 shows an exploded front view of a lacrosse stick according to an embodiment.
Figure 2:
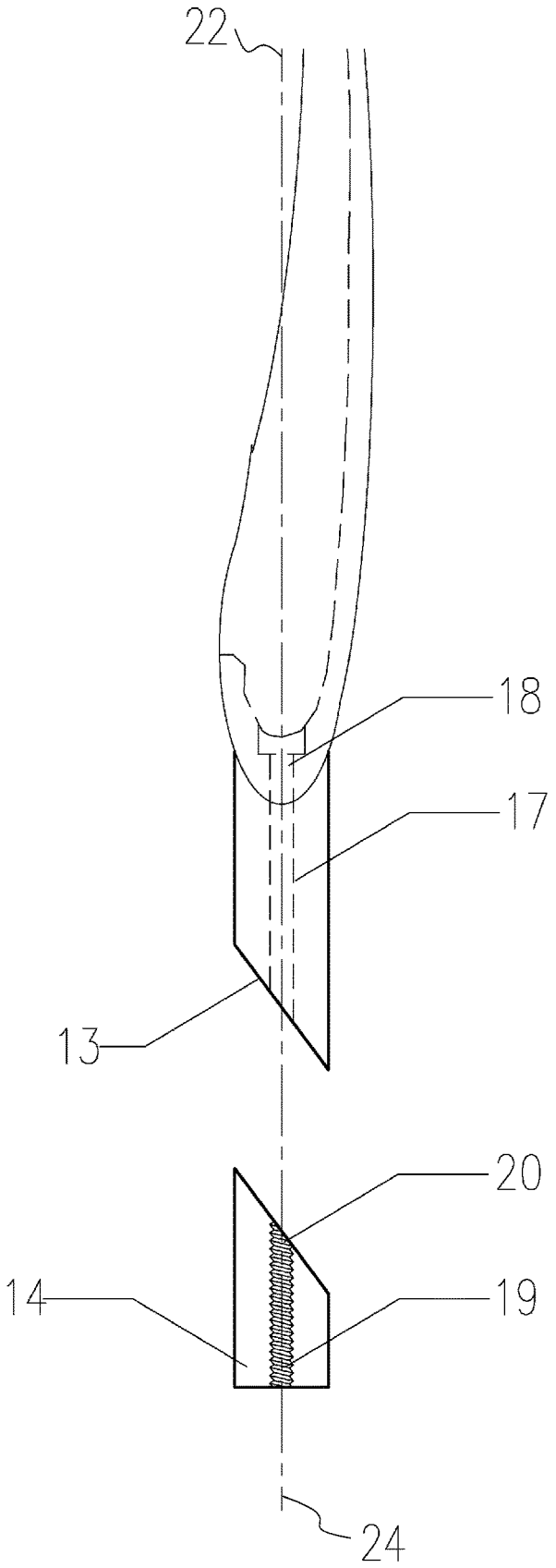
FIG. 2 shows an exploded side view of the lacrosse stick according to an embodiment.
Figure 3:
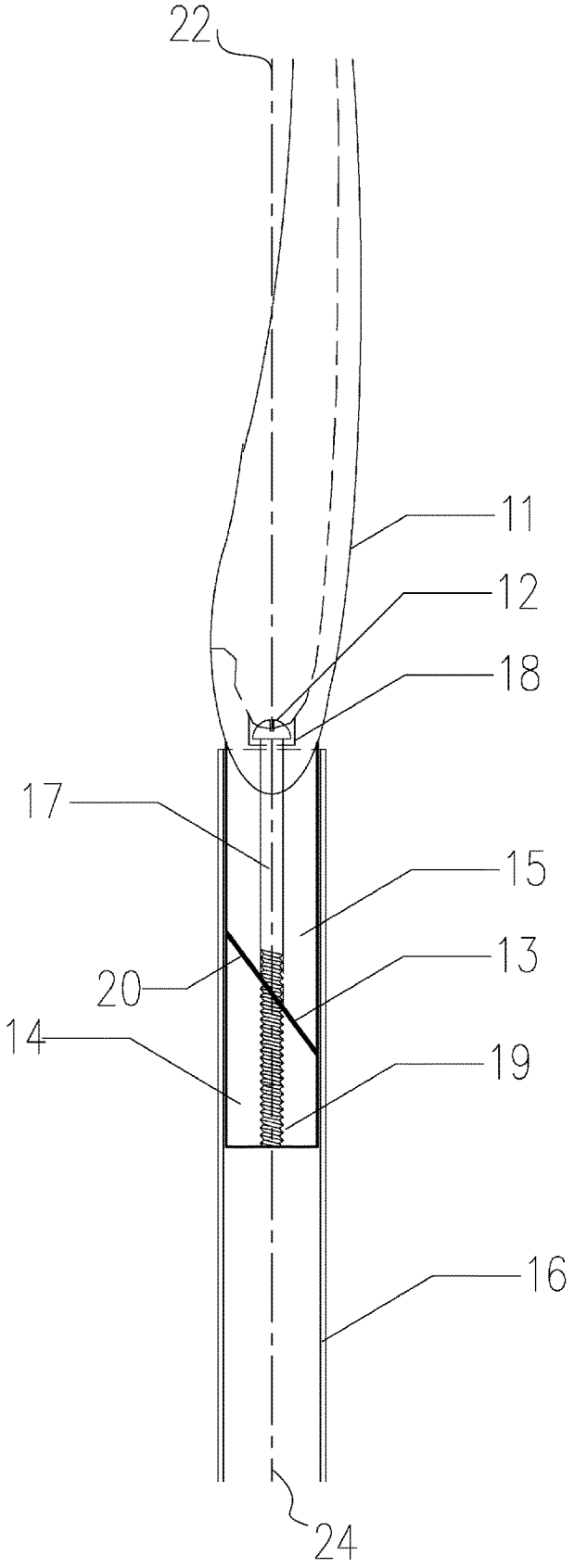
FIG. 3 shows an assembled view of the lacrosse stick according to an embodiment.

In FIGS. 1, 2, and 3 is shown a lacrosse stick head according to an embodiment. FIG. 1 shows a front view of the lacrosse stick head comprised of a protrusion at the base of the lacrosse stick head, which has a wedged end. The wedged end makes contact with a wedged end cap, which are drawn together via a screw through the centerline of the lacrosse stick head and mated to threads in the wedged end cap.

FIG. 2 shows a side view of the lacrosse stick head comprised of a protrusion at the base of the lacrosse stick head, which has a wedged end. The wedged end makes contact with a wedged end cap, which are drawn together via a screw through the centerline of the lacrosse stick head and mated to threads in the wedged end cap.

FIG. 3 shows a side view of the lacrosse stick head mounted to the lacrosse stick handle or pole via the tightening screw. The tightening screw creates wedging force internal to the lacrosse handle or pole therefore securing the lacrosse stick head to the lacrosse stick handle or pole.

The lacrosse stick head has a protruding end 15 at its base, which is to be inserted into the end of the lacrosse handle or pole 16. The protrusion at the base of the lacrosse stick head 11 will have an angled end 13, and a wedge tightening screw tunnel 17 to accommodate the wedge tightening screw 12.

The wedge tightening screw tunnel 17 will be through the centerline of the protruding base 15 of the lacrosse stick head 11. The lacrosse stick head 11 will have a recess 18 to accommodate the head of the wedge tightening screw 12 positioned at the top of the wedge tightening screw tunnel 17 to accommodate the head of the head of the wedge tightening screw 12.

The wedge end cap 14 will fit internal to the lacrosse stick handle or pole 16, will have some internal threads along its centerline to accommodate the wedge tightening screw 12 and have an angle on the end cap 20 to make contact with and supplement or approximately supplement the angle at the end on the protruding base 13 of the lacrosse stick head 11.

The lacrosse stick head 11 and wedge end cap 14 will be mounted to the lacrosse stick handle or pole 16 by inserting the wedge tightening screw 12 into the wedge tightening screw tunnel 17 in the base of the lacrosse stick head 11. The wedge end cap 14 will have its angle on the end cap 20 positioned at a supplemental angle at the end of protruding base of the lacrosse stick head 13. The wedge tightening screw 12 will then mate with the threads for the wedge tightening screw 19 on the wedge end cap 14.

The assembly of the lacrosse stick head 11 connected to the wedge end cap 14 via the wedge tightening screw 12 will be inserted into the end of the lacrosse stick handle or pole 16. By tightening the wedge tightening screw 12 the wedge end cap 14 will be drawn towards the angle at the end of the protruding base 13 of the lacrosse stick head 11. Tightening the wedge tightening screw 12 to the wedge end cap 14 via the threads for the wedge tightening screw 19 will force the wedge end cap 14 to move into the offset position relative to the protruding base of the lacrosse stick head 15.

Increasing the offset between the protruding end if the lacrosse stick head 15 and the wedge end cap 14 will reduce the space between the wedge end cap 14 and the inner wall of the lacrosse stick handle or pole 16 and increasing the offset between the protruding end if the lacrosse stick head 15 and the wedge end cap 14 will reduce the space between the protruding base of the lacrosse stick head 15 and the inner wall of the lacrosse stick handle or pole 16 thereby wedging the lacrosse stick head 11 and wedge end cap 14 inside of the lacrosse stick handle or pole 16 creating the union of the lacrosse stick head 11 to the lacrosse stick handle or pole 16.

In one embodiment, a lacrosse stick head 11 has a first wedge surface 13 of a base 15 and an oblique wedged end cap 20 and a head longitudinal axis 22. The oblique wedged end cap 20 is disposed proximate to the first wedge surface 13. The head longitudinal axis 22 is substantially coaxial with a head base longitudinal axis 24.

A head assembly made up of the lacrosse stick head 11 and the oblique wedged end cap 20 is inserted into a handle 16. A fastener 12 is passed through a throat of the lacrosse stick head 11 and is substantially coaxial with the head longitudinal axis 22.

The handle 16 may have a cross-section that is circular, square, triangular, oval, or a polygon.

An angle of the first wedge surface 13 relative to the head longitudinal axis 22 may be oblique, acute, nonzero, positive, 30°, and 45°.

Contact between the first wedge surface 13 and the oblique wedged end cap 20 can be repositioned relative to each other to create an offset relative to an axial position of the first wedge surface 13 and the oblique wedged end cap 20 that resists rotation of the lacrosse stick head 11 about the handle longitudinal axis 22.

Contact between the first wedge surface 13 and the oblique wedged end cap 20 can be repositioned relative to each other to create an offset relative to an axial position of the first wedge surface 13 and the oblique wedged end cap 20 that resists longitudinal motion of the lacrosse stick head 11 along the handle longitudinal axis 22.

The fastener 12 may be a head screw, a bolt, a rivet, a spike, and an anchor.

In another embodiment, a lacrosse stick head mounting system has a head 11 having a throat 15 and a basket. The head 11 is fastened to a handle by a fastener 12. The throat 15 has a planar throat surface 13 at an oblique angle to an axis of rotation 22 of the fastener 12 through the throat 15. An oblique wedged end cap 14 has a planar handle surface 20 at the oblique angle to the axis of rotation 22. The planar handle surface 20 contacts the planar throat surface 13 to resist rotation of the head 11 about the axis of rotation 22.

In several embodiments, the improved mounting of the lacrosse stick head to the lacrosse stick handle or pole will allow for the lacrosse stick head redesign to be more streamlined due to the lacrosse stick head mount being totally internal to the lacrosse stick handle or pole.

The improved mounting of the lacrosse stick head to the lacrosse stick handle or pole will increase the torsion load, which can be placed on the lacrosse stick head, lacrosse, handle or pole assembly.

The improved mounting of the lacrosse stick head to the lacrosse stick handle or pole will allow for fewer repairs than the old single screw mounting which penetrates the lacrosse stick head and lacrosse stick pole or handle where the two said pieces overlap due to needed to retightening due to screw loosening from vibration or torsion forces.

The improved mounting of the lacrosse stick head to the lacrosse stick handle or pole will contain more gripping force in the mounting contact area between the lacrosse stick mount and the lacrosse stick handle or pole creating a stronger union of the lacrosse stick head to the lacrosse stick handle or pole.

The improved mounting of the lacrosse stick head to the lacrosse stick handle or pole will allow for a stronger union of the lacrosse stick head to the lacrosse handle or pole and increase the torsion load, which can be placed on the lacrosse stick head, lacrosse, handle or pole assembly.

Mounting the wedge tightening screw to be internal to the lacrosse stick head will allow for fewer repairs versus the old external single screw mounting which penetrates from an external position the lacrosse stick head and lacrosse stick handle or pole where the two said pieces overlap and need retightening due to screw loosening from vibration or torsion forces.

The improved mounting of the lacrosse stick head to the lacrosse stick handle or pole will allow for a lacrosse stick head redesign that would allow for a smoother union between the lacrosse stick head and lacrosse stick handle or pole thereby reducing possible injuries.

The improved mounting of the lacrosse stick head to the lacrosse stick handle or pole will reduce lacrosse stick head breakage at the mounting supports due to the mounting will be internal to the lacrosse handle or pole versus the existing mounting being external to the lacrosse stick pole or handle.

Although the description above contains many specificities, these should not be construed as limiting the scope of the invention but as merely providing illustrations of some of the presently preferred embodiments of this invention.

For example, the protruding base of the lacrosse stick head and wedge end cap can be of any external shape to accommodate the interior of the lacrosse stick handle or pole, the upper portion of the lacrosse stick head can be of various designs and colors, the lacrosse stick handle or pole can be of various designs, etc.

REFERENCE NUMERALS IN DRAWINGS

11 lacrosse stick head
12 wedge tightening screw
13 angle at the end of protruding base
14 wedge end cap
15 protruding base of lacrosse stick head
16 lacrosse stick handle or pole
17 wedge tightening screw tunnel
18 recess for wedge tightening screw head
19 threads for wedge tightening screw
20 angle on end cap The foregoing has described the principles, embodiments, and modes of operation of the present invention. However, the invention should not be construed as being limited to the particular embodiments described above, as they should be regarded as being illustrative and not restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that the invention may be practiced otherwise than as specifically described herein.

What is claimed is:

1. A lacrosse stick head mounting system comprising:

a protruding end extending from a base of a lacrosse stick head and passing directly through a throat of and being internal to a handle of a lacrosse stick, the protruding end having an angled end and comprising a wedge tightening screw tunnel extending from the base, the lacrosse stick head having a head longitudinal axis, and the base of the lacrosse stick head contacting the handle directly;

a wedge tightening screw insertable into the wedge tightening screw tunnel through the base of the lacrosse stick head, the head of the wedge tightening screw recessed into the base of the lacrosse stick head; and a wedge end cap internal to the handle of the lacrosse stick and comprising an end cap and threads to tighten the wedge tightening screw, the angled end of the protruding end to contact the end cap of the wedge end cap, wherein the protruding end of the lacrosse stick head, the wedge tightening screw, and the wedge endcap being insertable directly into an end of the handle of the lacrosse stick along a head base longitudinal axis substantially coaxial with the head longitudinal axis and, as the wedge tightening screw is tightened through the threads of the wedge end cap, the wedge cap tightening screw to draw the wedge end cap towards the angled end of the protruding end of the lacrosse stick head, to move the wedge end cap into an offset position relative to the protruding end of the lacrosse stick head, and to wedge the protruding end of the lacrosse stick head and the wedge endcap inside of the handle and without overlap of the lacrosse stick head with the handle external to the handle, wherein a cross-section of the handle comprises one of:
square,
triangular,
oval, and
polygon; and wherein an angle of the angled end relative to a head longitudinal axis comprises one of:
30°, and
45°.

2. The lacrosse stick head mounting system of claim 1, wherein contact between the angled end and the end cap can be repositioned relative to each other to create an offset relative to an axial position of the angled end and the end cap that resists rotation of the lacrosse stick head about a handle longitudinal axis.

3. The lacrosse stick head mounting system of claim 1, wherein contact between the angled end and the end cap can be repositioned relative to each other to create an offset relative to an axial position of the angled end and the end cap that resists longitudinal motion of the lacrosse stick head along a handle longitudinal axis.

4. The lacrosse stick head mounting system of claim 1, wherein the wedge tightening screw comprises a head screw.

5. A lacrosse stick comprising:

a lacrosse stick head having a base;

a handle; and a lacrosse stick head mounting system, comprising a protruding end extending from a base of a lacrosse stick head and passing directly through a throat of and being internal to a handle of a lacrosse stick, the protruding end having an angled end and comprising a wedge tightening screw tunnel extending from the base, the lacrosse stick head having a head longitudinal axis, and the base of the lacrosse stick head contacting the handle directly;

a wedge tightening screw insertable into the wedge tightening screw tunnel through the base of the lacrosse stick head, the head of the wedge tightening screw recessed into the base of the lacrosse stick head; and a wedge end cap internal to the handle of the lacrosse stick and comprising an end cap and threads to tighten the wedge tightening screw, the angled end of the protruding end to contact the end cap of the wedge end cap, wherein the protruding end of the lacrosse stick head, the wedge tightening screw, and the wedge endcap being insertable directly into an end of the handle of the lacrosse stick along a head base longitudinal axis substantially coaxial with the head longitudinal axis and, as the wedge tightening screw is tightened through the threads of the wedge end cap, the wedge cap tightening screw to draw the wedge end cap towards the angled end of the protruding end of the lacrosse stick head, to move the wedge end cap into an offset position relative to the protruding end of the lacrosse stick head, and to wedge the protruding end of the lacrosse stick head and the wedge endcap inside of the handle and without overlap of the lacrosse stick head with the handle external to the handle, wherein a cross-section of the handle comprises one of:
square,
triangular,
oval, and polygon; and wherein an angle of the angled end relative to a head longitudinal axis comprises one of:

30°, and

45°.

6. The lacrosse stick as in claim 5, wherein the base of the lacrosse stick head including a recess opposite to the protruding end extending from the based.

7. The lacrosse stick of claim 5, wherein contact between the angled end and the end cap can be repositioned relative to each other to create an offset relative to an axial position of the angled end and the end cap that resists rotation of the lacrosse stick head about a handle longitudinal axis.

8. The lacrosse stick of claim 5, wherein contact between the angled end and the end cap can be repositioned relative to each other to create an offset relative to an axial position of the angled end and the end cap that resists longitudinal motion of the lacrosse stick head along a handle longitudinal axis.

9. The lacrosse stick of claim 5, wherein the wedge tightening screw comprises a head screw.

10. The lacrosse stick of claim 5, wherein the lacrosse stick head mounting system provides a secure internal mount to allow a continuous presentation of the handle to the base of the mounted lacrosse stick.

11. The lacrosse stick of claim 5, wherein the lacrosse stick head mounting system is internal to the lacrosse stick and no fasteners are visible.

12. The lacrosse stick of claim 5, wherein the lacrosse stick head mounting system is internal to the lacrosse stick.

13. A lacrosse stick comprising:

a lacrosse stick head having a base;

a handle; and a lacrosse stick head mounting system including a fastener to pass directly through a throat of the handle and to attach the lacrosse stick head directly to the handle through the base of the lacrosse stick head and internal to the handle of the lacrosse stick without overlap of the lacrosse stick head with the handle external to the handle, and the base of the lacrosse stick head contacting the handle directly, wherein a cross-section of the handle comprises one of:

square, triangular, oval, and polygon; and wherein an angle of an angled end relative of the fastener to a head longitudinal axis comprises one of:

30°, and

45°.

* * * * *